US005611388A

United States Patent [19]

Fukuoka et al.

[11] Patent Number: 5,611,388

[45] Date of Patent: Mar. 18, 1997

[54] METHOD OF AND APPARATUS FOR LOW-PRESSURE CASTING

[75] Inventors: Hirofumi Fukuoka; Junzou Fujiya; Yoshiaki Uena; Akihiro Nakano, all of Hiroshima, Japan

[73] Assignee: Mazda Motor Corporation, Hiroshima-ken, Japan

[21] Appl. No.: 298,611

[22] Filed: Aug. 31, 1994

[30] Foreign Application Priority Data

Sep. 2, 1993 [JP] Japan ..... 5-218422
Mar. 24, 1994 [JP] Japan ..... 6-053760

[51] Int. Cl.[6] ..... B22D 18/04; B22D 33/04

[52] U.S. Cl. ..... 164/119; 164/137; 164/306; 164/340

[58] Field of Search ..... 164/113, 119, 164/137, 306, 312, 339, 340

[56] References Cited

FOREIGN PATENT DOCUMENTS 2646187 4/1978 Germany .
53-130225 11/1978 Japan .
54-080235 6/1979 Japan .
60-137547 7/1985 Japan ..... 164/340
63-72466 2/1988 Japan .
63-072466 4/1988 Japan .
64-53755 1/1989 Japan .
8903452 9/1989 Japan .
2-127957 5/1990 Japan ..... 164/137
2208817 4/1989 United Kingdom .

*Primary Examiner*—Kuang Y. Lin
*Attorney, Agent, or Firm*—Sixbey, Friedman, Leedom & Ferguson, P.C.; Gerald J. Ferguson, Jr.; Donald R. Studebaker

[57] ABSTRACT

A casting mold for a low-pressure casting apparatus can be opened and closed and is closed to form therein a cavity which is filled with molten metal to form a cast product. The casting mold includes an upper mold of metal, a lower mold of metal and a sand mold which is disposed between the upper and lower molds and forms a part of the cavity. A top wall of the cavity is formed by a lower surface of the upper mold, at least a part of a side wall of the cavity is formed by the sand mold so that the upper mold contacts with the molten metal filled in the cavity in a larger area than the lower mold.

23 Claims, 17 Drawing Sheets

METHOD OF AND APPARATUS FOR LOW-PRESSURE CASTING

BACKGROUND OF THE INVENTION

1. Field of the Invention

This invention relates to a method of and an apparatus for low-pressure casting, and more particularly to those which facilitate automation of the casting step.

2. Description of the Prior Art

Low-pressure casting has been wide used for mass production of, for instance, cylinder heads of automotive engines. In the low-pressure casting, molten light metal such as aluminum alloy held in a tightly enclosed vessel is cast in a cavity in a mold under a relatively low pressure of inert gas or air applied to the surface of the molten metal.

Generally the mold employed in such low-pressure casting is of metal and comprises a lower mold, an upper mold which is moved up and down toward and away from the lower mold and a pair of slide molds which are disposed between the upper and lower molds to be movable left and right and are slidably engaged with the upper and lower molds. When these molds are closed, a cavity having a shape conforming to the shape of a product to be cast is formed.

In such a casting mold, since the cavity is entirely surrounded by metal walls, molten metal cast in the mold is robbed of a large amount of heat upon contact with the cavity wall and especially the molten metal cast in a part of the cavity which defines a thin part of the product is very quickly cooled.

As a result, molten metal cannot be fed deep into the cavity or flow marks can be generated on the surface of the product. Further the mold can expand due to heat of the molten metal and the cavity can be partly narrowed, which can result in short molding and/or products with defects due to residual gas in the cavity.

When a sand mold having a small specific heat is used instead of the metal mold, temperature drop of the molten metal and short molding can be minimized. However since a pressure is applied to the molten metal during casting and solidifying step, the sand mold can be broken or moved. Accordingly, this approach cannot be applied to casting of precision products.

In order to overcome these problems, a novel method of low-pressure casting and a novel structure of a casting mold have been proposed, for instance, in Japanese Unexamined Patent Publication No. 63(1988)-72466.

In the method of low-pressure casting, the cavity is formed by a sand mold, and the sand mold is supported by metal molds. Then molten metal is cast in the cavity and is held under a pressure.

The structure of the casting mold comprises a sand mold forming a cavity, metal molds supporting the sand mold, and a gas discharge passage which communicates with the sand mold through the metal molds and discharges gas in the cavity.

However in the method and the structure of the casting mold, since the cavity is wholly formed by the sand mold, the cast product remains on the lower mold held in the sand mold after the casting mold is opened with the upper mold moved upward and the slide molds moved away from each other.

Therefore, a troublesome work and a long time are required to remove the cast product and the sand mold from the lower mold. Further the sand scattered over the upper surface of the lower mold when the sand mold is removed from the lower mold must be cleared off the lower mold, which takes a long time. These problems prevents shortening of the casting cycle and obstructs automation of the casting step.

SUMMARY OF THE INVENTION

In view of the foregoing observations and description, the primary object of the present invention is to provide a method of and an apparatus for low-pressure casting which is suitable for automation of the casting step, can greatly shorten the casting cycle time and can improve the quality of the cast molds.

A low-pressure casting apparatus in accordance with a first aspect of the present invention is provided with a casting mold which can be opened and closed and is closed to form therein a cavity which is filled with molten metal to form a cast product and characterized in that said casting mold comprises an upper mold of metal, a lower mold of metal and a sand mold which is disposed between the upper and lower molds and forms a part of the cavity.

In one embodiment, a top wall of the cavity is formed by a lower surface of the upper mold, at least a part of a side wall of the cavity is formed by the sand mold, and the upper mold contacts with the molten metal filled in the cavity in a larger area than the lower mold.

With this arrangement, the cast product is lifted together with the sand mold trailed by the upper mold when the upper mold is moved upward away from the lower mold to open the casting mold 1, and accordingly removal of the cast product is facilitated, which makes it feasible automation of the casting step. Further since no sand remains on the lower mold cleaning of the casting mold is simplified, which result in shortening of the casting cycle time coupled with facilitation of removal of the products.

Preferably, the upper mold is provided with a holding means for holding the cast product on the lower surface of the upper mold when the casting mold is opened in order to more surely lift the cast product and the sand mold together.

The holding means may be a projecting member which projects into the cavity from the lower surface of the upper mold. This is advantageous in that the upper mold need not be additionally provided with such a means.

A bulge portion may be formed on the upper surface of the lower mold and a gate may be formed between a side wall of the bulge portion and a side wall of the sand mold. This makes the molten metal in the gates to be solidified at a lower rate than that forming the product and can result in a higher quality of the cast product.

Further when a metal member which forms a part of the cavity is mounted on the bulge portion, a coolant passage can be formed in the metal member so that the molten metal in the cavity can be quickly cooled.

In one preferred embodiment, a limiting member for limiting the space between the upper and lower molds is formed integrally with the upper mold. With this arrangement, the distance between the lower and upper molds can be held proper without slide mold. More preferably the limiting member is formed so as to surround the sand mold. This arrangement eliminates possibility of molten metal leaking out the casting mold 1 even if the side walls of the cavities are formed by the sand mold.

In another preferred embodiment, the sand mold comprises a base frame, a core member disposed on the base frame, and an outer frame which is disposed on the base frame to support the core member together with the base frame and forms four side walls of the cavity. This arrangement permits the sand mold to be set to the lower mold by an automated system.

The casting mold may be provided with a pair of sand molds so that a pair of cast products can be cast by one casting operation.

A low-pressure casting method in accordance with a second aspect of the present invention comprises the steps of preparing a casting mold comprising an upper metal mold, a lower metal mold and a sand mold which is disposed between the upper and lower metal molds, forming a part of a cavity by the metal molds and the other part of the cavity by the sand mold, filling the cavity with molten metal, and opening the casting mold after the molten metal is solidified.

In one preferred embodiment, a top wall of the cavity is formed by the upper metal mold, the other part of the wall of the cavity is formed by the lower metal mold, the casting mold is opened with the cast product and the sand mold held on the upper mold and then the cast product and the sand mold are removed from the upper mold. This facilitates removal of the cast product and makes it feasible automation of the casting step, and at the same time results in shortening of the casting cycle time.

Preferably, the sand mold is in the form of a core assembly having an opening on an upper side thereof prepared by positioning a core member on a base frame and positioning an outer frame on the core member, and the core assembly is placed on the lower mold, and the upper mold is placed on the core assembly to close the opening of the core assembly. This method permits the sand mold to be set to the lower mold by an automated system, which permits the casting step to be automated and shortens the casting cycle time.

DESCRIPTION OF THE PREFERRED EMBODIMENT

Figure 1:
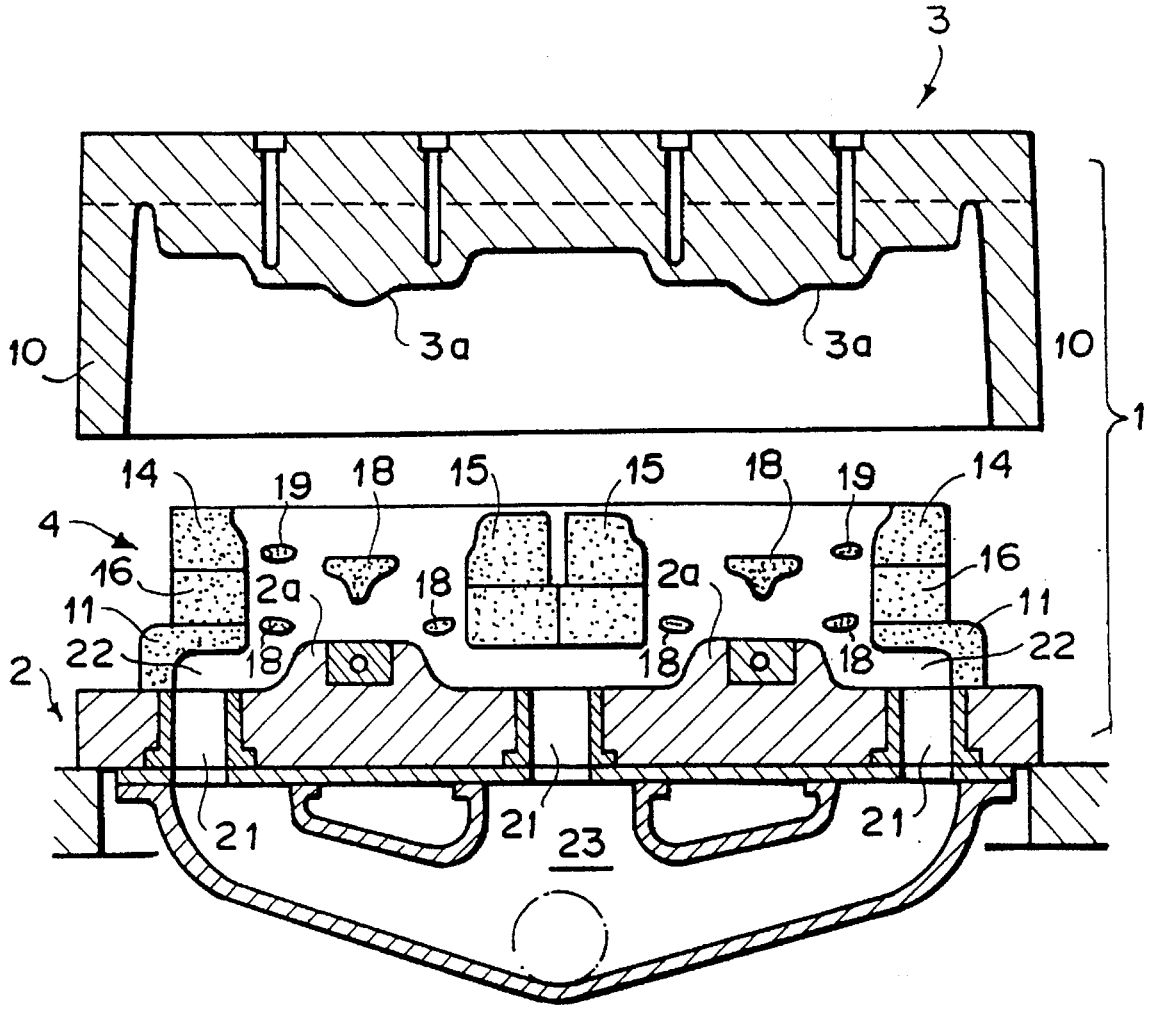
FIG. 1 is a cross-sectional view of a casting mold employed in a casting machine of a low-pressure casting apparatus in accordance with an embodiment of the present invention.
Figure 2:
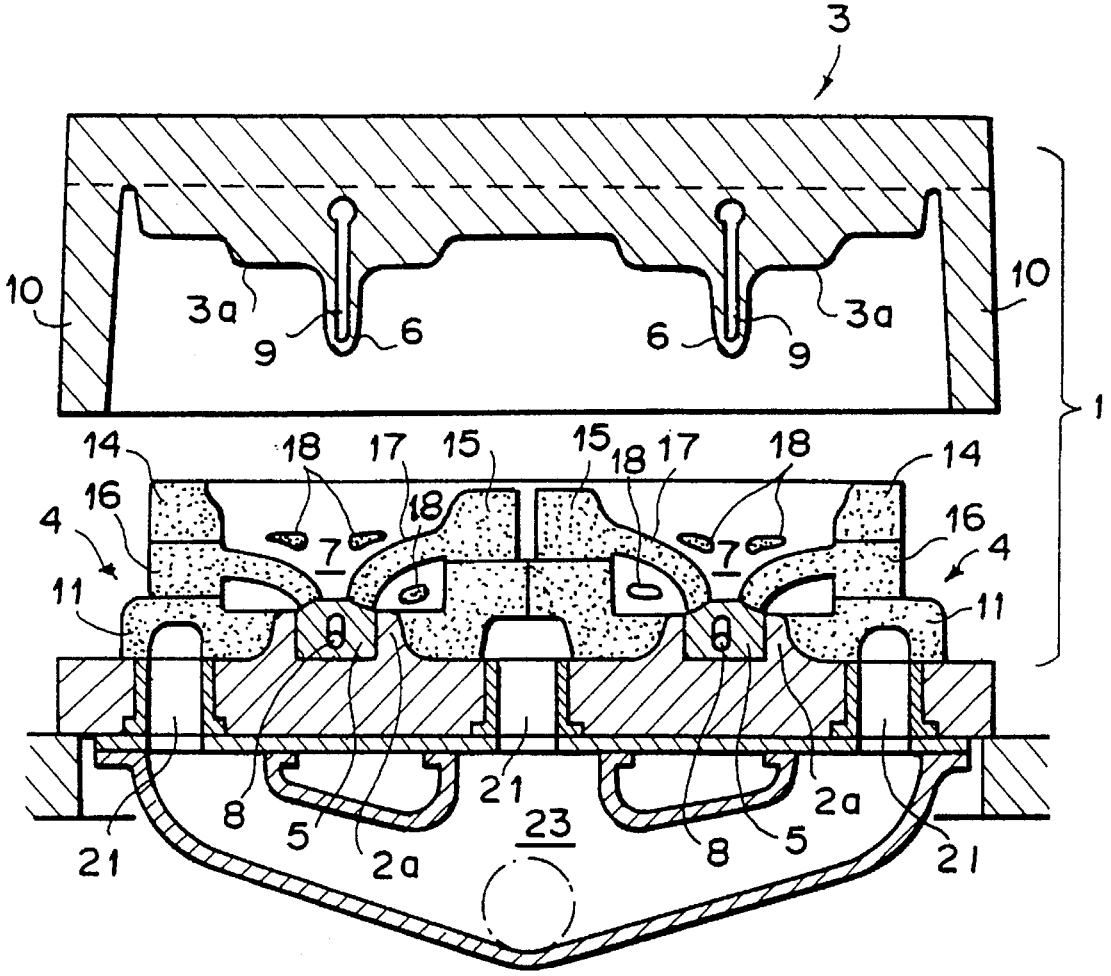
FIG. 2 is another cross-sectional view of the casting mold.
Figure 5:
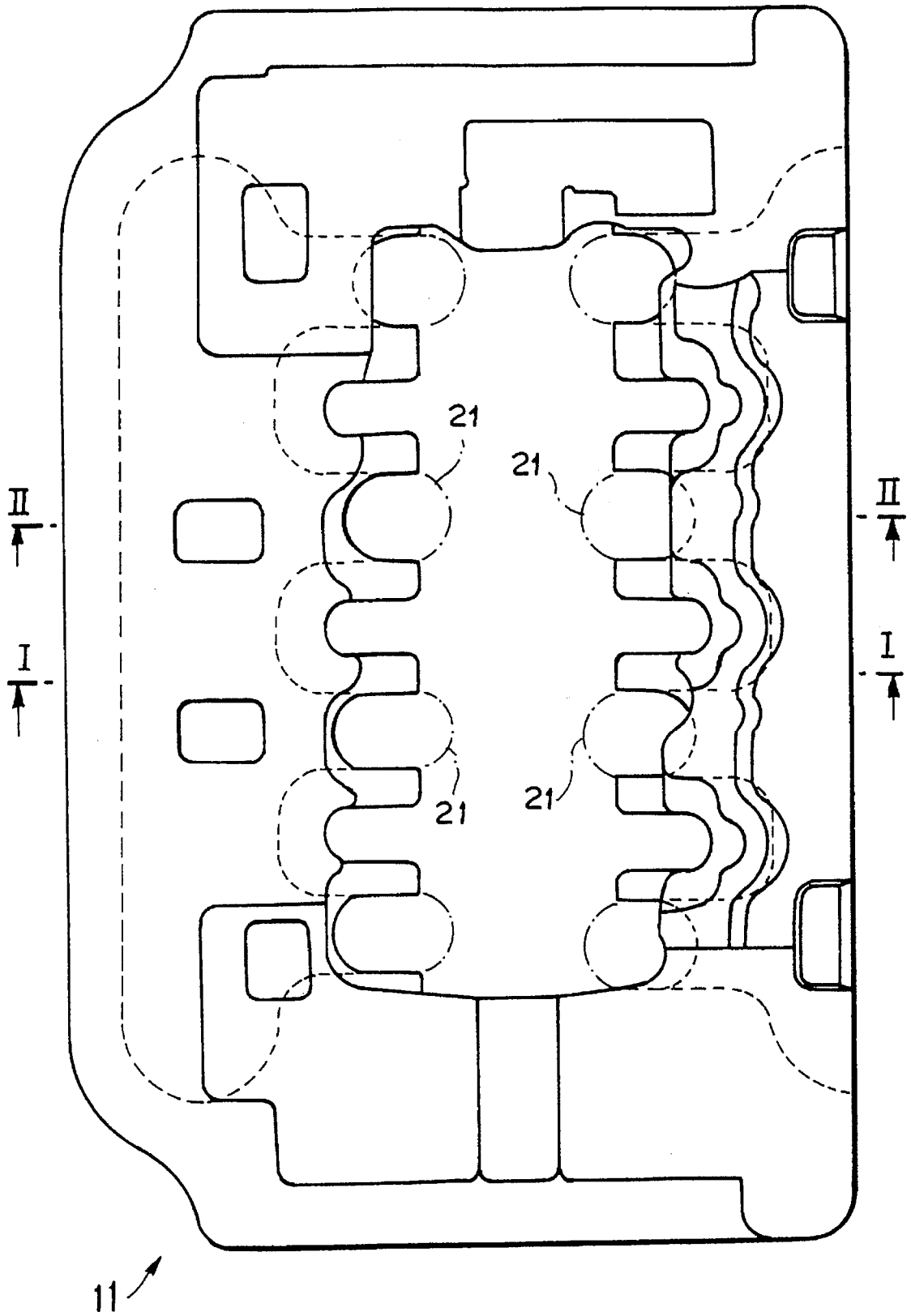
FIG. 5 is a plan view of a lower frame of the core assembly.
Figure 6A:
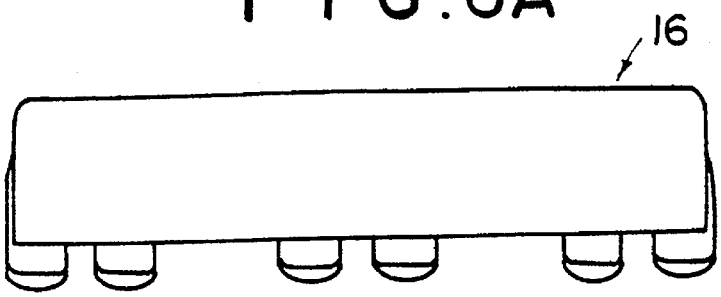
FIG. 6A is a rear view of a sand core for forming exhaust ports.
Figure 6B:
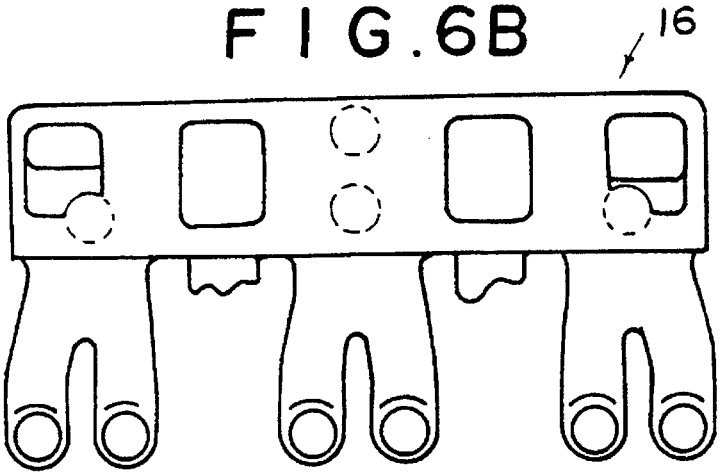
FIG. 6B is a plan view of the same.
Figure 6C:
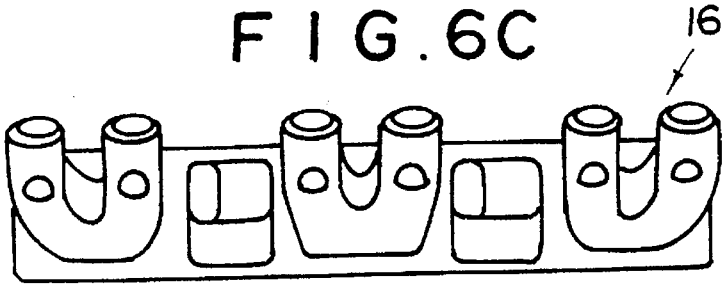
FIG. 6C is a front view of the same.
Figure 6D:
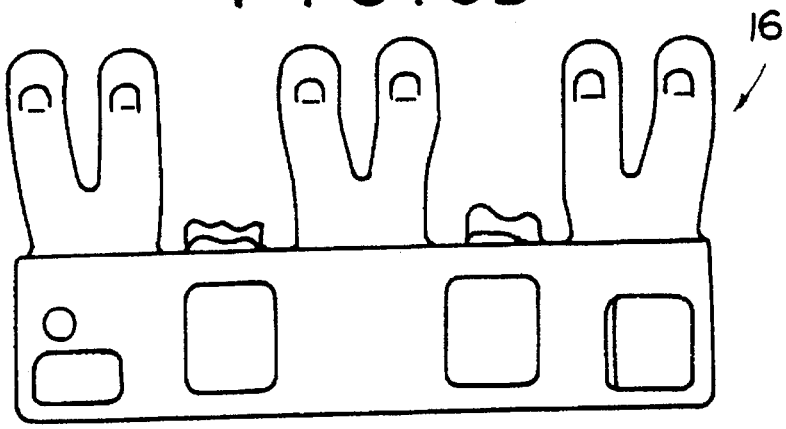
FIG. 6D is a bottom view of the same.
Figure 7A:
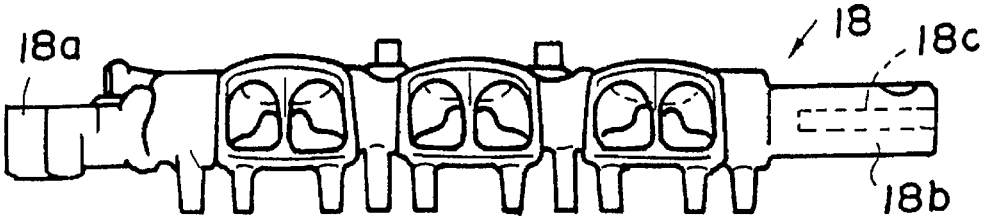
FIG. 7A is a rear view of a sand core for forming a water jacket.
Figure 7B:
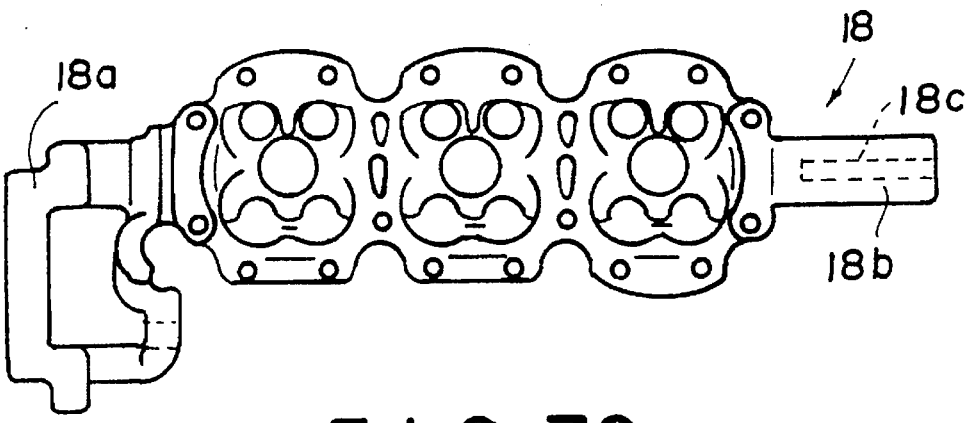
FIG. 7B is a plan view of the same.
Figure 7C:
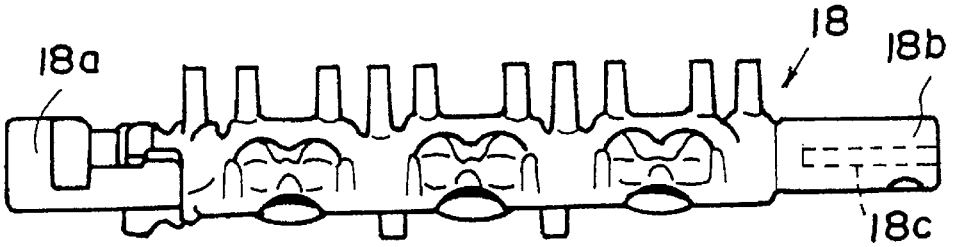
FIG. 7C is a front view of the same.
Figure 7D:
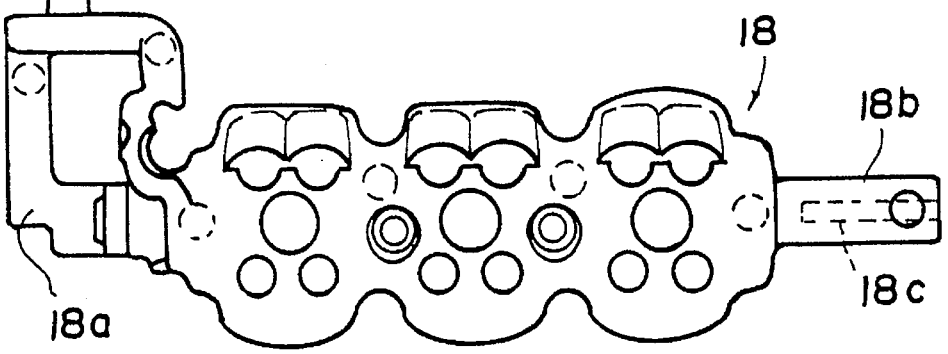
FIG. 7D is a bottom view of the same.

A low-pressure casting apparatus in accordance with an embodiment of the present invention which is for casting at one time a pair of cylinder heads for a V-6 engine will be described, hereinbelow. FIGS. 1 and 2 are cross-sectional views showing a casting mold, with the upper and lower molds apart from each other, which is mounted on a casting machine of the low-pressure casting apparatus. FIGS. 1 and 2 are respectively taken along lines I—I and II—II in FIG. 5 which is a plan view of a base frame 11 of a core assembly 4 to be described later.

In FIGS. 1 and 2, a casting mold 1 comprises a lower mold 2 consisting of one metal mold, an upper mold 3 consisting of one metal mold and a pair of core assemblies 4 which solely consist of sand molds and are disposed between the lower and upper molds 2 and 3. Metal telescopic members 5 for forming combustion chambers are fit in bulge portions 2*a* formed on the upper surface of the lower mold 2 and core pins 6 for forming plug holes extend toward the lower mold 2 from a lower surface of the upper mold 3. When the lower and upper molds 2 and 3 are closed with the core assemblies 4 positioned in a predetermined place, cavities 7 are formed with the cavity walls formed by the lower mold 2, the upper mold 3, the core assemblies 4, the telescopic members 5 and the core pins 6.

Coolant passages 8 and 9 are provided in the telescopic members 5 and the core pins 6 (FIG. 2). Reference numeral 10 denotes a spacer which limits the distance between the lower and upper molds 2 and 3 when the casting mold 1 is closed. The spacer 10 is formed integrally with the upper mold 3 along the periphery of the lower surface of the upper mold so as to surround the core assemblies 4 when the casting mold 1 is closed.

Figure 3:
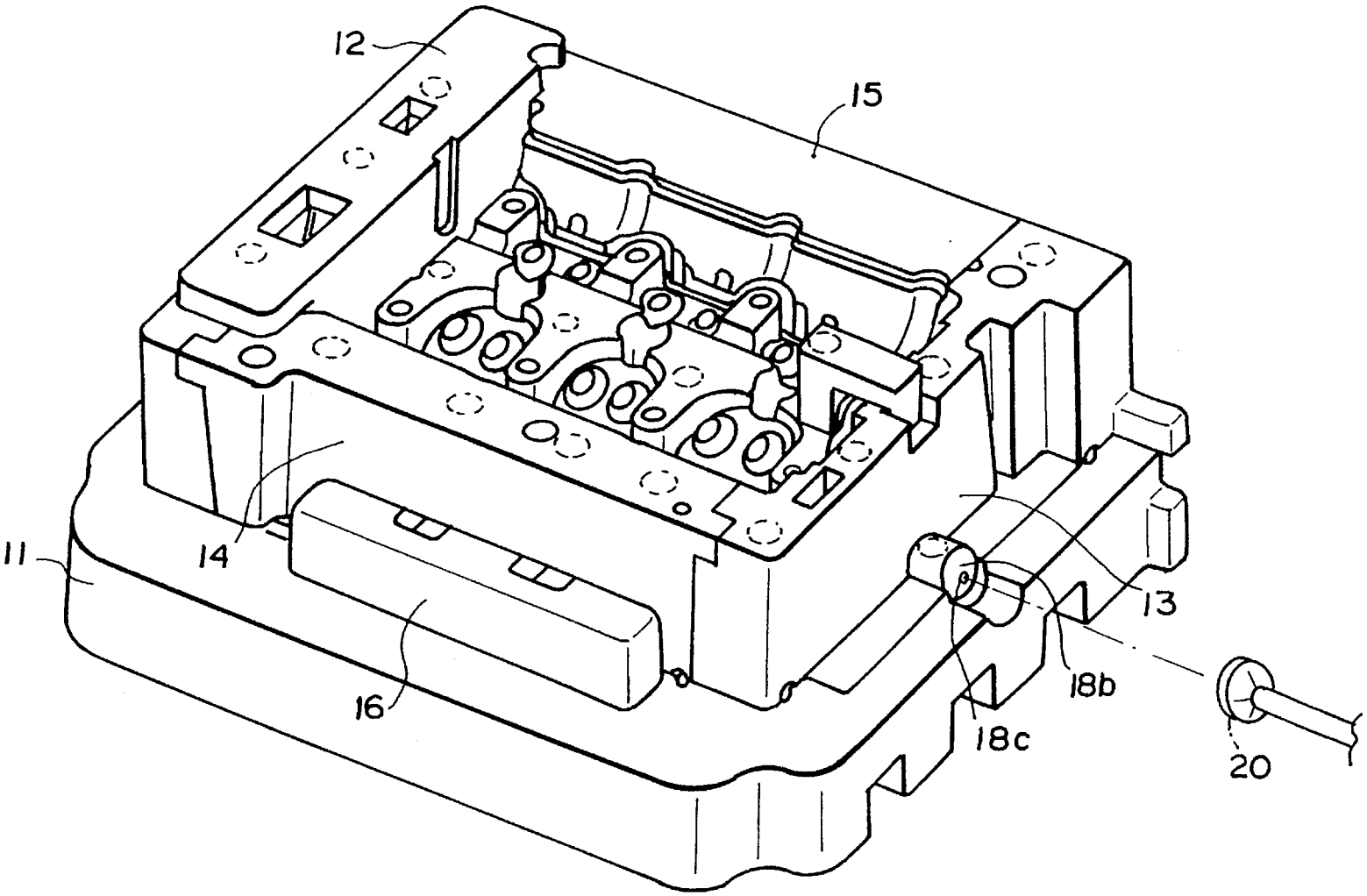
FIG. 3 is a perspective view of a core assembly.
Figure 4:
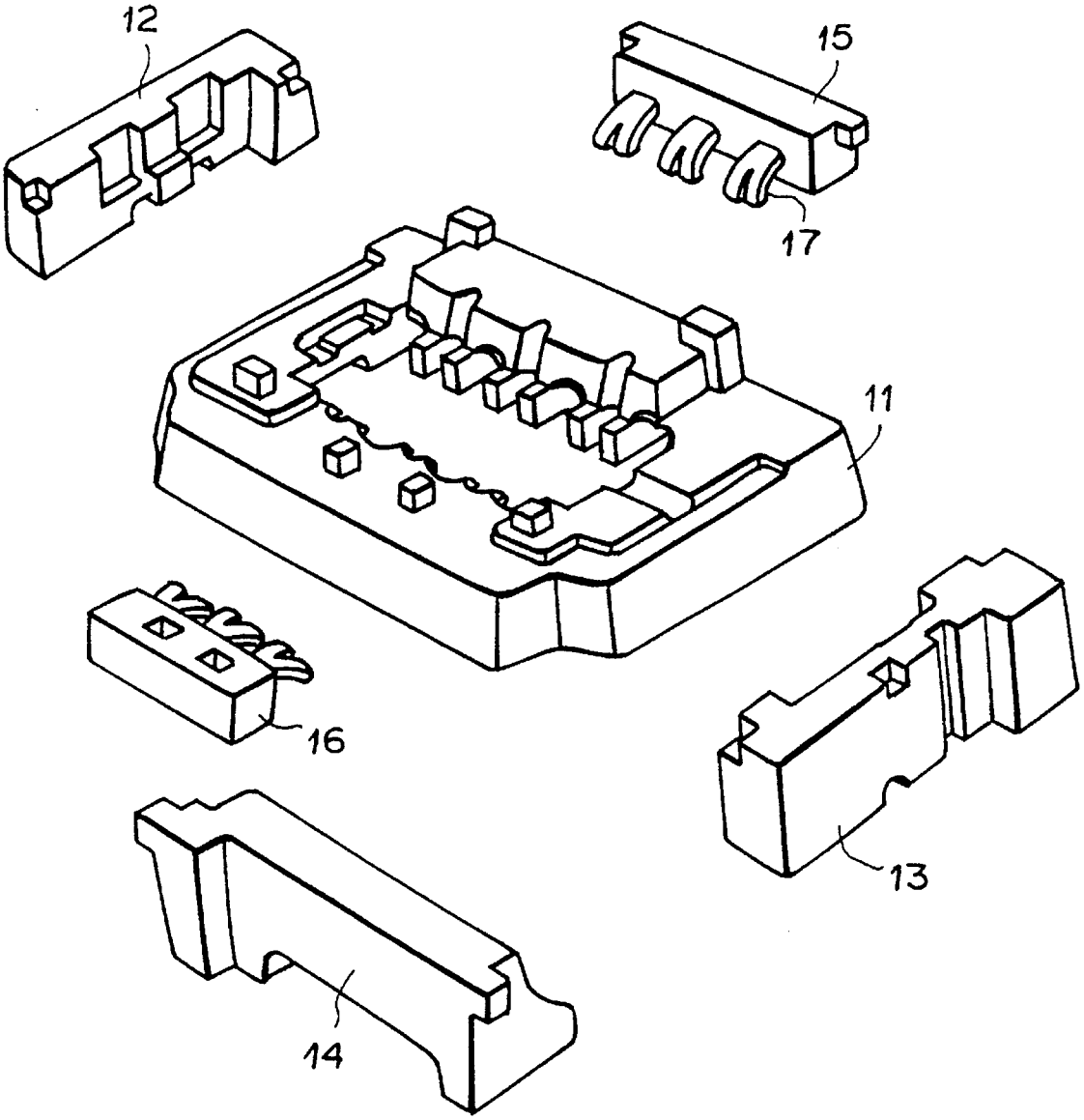
FIG. 4 is an exploded perspective view of the core assembly.

As shown in FIGS. 3 and 4, each core assembly 4 comprises a base frame 11 (shown in FIG. 5 in plan), four outer frames 12 to 15 of sand which are mounted on the base frame 11 and form four side walls of the cavity, a sand core 16 (FIGS. 6A to 6D) which is incorporated between the outer frame 14 and the base frame 11 and form exhaust ports, sand cores 17 which are formed integrally with the outer frame 15 and form intake ports, a sand core 18 (FIGS. 7A to 7D) which is provided with end portions 18*a* and 18*b* supported between the base frame 11 and the outer frame 12 and between the base frame 11 and the outer frame 13 and forms a water jacket, and a sand core 19 for forming an oil jacket. The core assembly 4 has an opening in the upper surface thereof.

Thus only the top wall of the cavity 7 is formed by a metal mold, i.e., the lower surface 3*a* of the upper mold 3 and the side walls and the bottom wall of the cavity are all formed by sand molds except a part of the bottom wall. Accordingly, the area in which the upper mold 3 is brought into contact with the molten metal is larger than that of the lower mold 2.

A vent passage 18*c* is formed through the end portion 18*b* of the sand core 18 for forming the water jacket and gas generated from the core during casting can be drawn out by connecting a suction nozzle 20 to the vent passage 18C.

The pair of core assemblies 4 in the assembled state are placed in a predetermined position on the lower mold 2 and the upper mold 3 is positioned on the core assemblies 4 so that the upper mold 3 closes the openings in the core assemblies 4, whereby the cavities 7 are formed.

As shown in FIGS. 1 and 2, the lower mold 2 is provided with three gates 21 one at the center and the others in the left and right edge portions thereof. The gate 21 in the right edge portion of the lower mold 2 communicates with the cavity 7 in the right side core assembly 4 through a gate 22 formed in the base frame 11 (which forms the bottom wall and the lower portion of the side wall of the cavity 7) and the gate 21 in the left edge portion of the lower mold 2 communicates with the cavity 7 in the left side core assembly 4 through another gate 22 formed in the base frame 11. The central gate 21 communicates with both the cavities 7 through still another gate 22 and the molten metal fed through the central gate 21 is distributed to both the cavities 7. The gates 22 are formed between the side walls of the bulge portions 2*a* of the lower mold 2 and the side walls of the base frames 11 which are of sand.

The lower mold 2 is mounted on a molten metal distributor 24 provided with a molten metal supply passage 23. Molten metal stored in a tightly closed furnace is injected into the distributor 24 through a stalk and and then into the cavities 7 through the gates 21 and 22 when the surface of the molten metal in the furnace is pressed by air under a low pressure.

Since the core pins 6 fixed to the upper mold 3 to extend into the cavities 7 are caught by the cast products when the molten metal is solidified and at the same time the upper mold 3 is in contact with the molten metal in a larger area than the lower mold 2, the cast products are lifted together with the core assemblies 4 trailed by the upper mold 3 when the upper mold 3 is moved upward to open the casting mold 1.

Accordingly removal of the cast products is facilitated, which makes it feasible automation of the casting step. Further since no sand remains on the lower mold 2 cleaning of the casting mold 1 is simplified, which result in shortening of the casting cycle time coupled with facilitation of removal of the products.

Further in this particular embodiment, since the core pins 6 are used as a means for holding the cast products together with the core assemblies 4, the upper mold 3 need not be additionally provided with such a means.

Further since the telescopic members 5 of metal are fit in the bulge portions 2*a* formed on the upper surface of the lower mold 2, and the gates 22 are formed by the side walls of the bulge portions 2*a* and the side walls of the sand mold, the molten metal in the gates 22 is solidified at a lower rate than that forming the product, which can result in a higher quality of the cast product.

Further since the spacer 10 for limiting the distance between the lower and upper molds 2 and 3 upon closure of the casting mold 1 is provided so as to surround the core assemblies 4 when the casting mold 1 is closed, the distance between the lower and upper molds 2 and 3 can be held proper without slide mold and there is no possibility of molten metal leaking out the casting mold 1 even if the side walls of the cavities 7 are formed by sand molds.

Further, in this particular embodiment, since the core assemblies 4 are set to the lower mold 2 with the sand cores 16 to 19 having been assembled into the core assemblies 4, automation of the casting step is further facilitated and the casting cycle time is further shortened.

Figure 8:
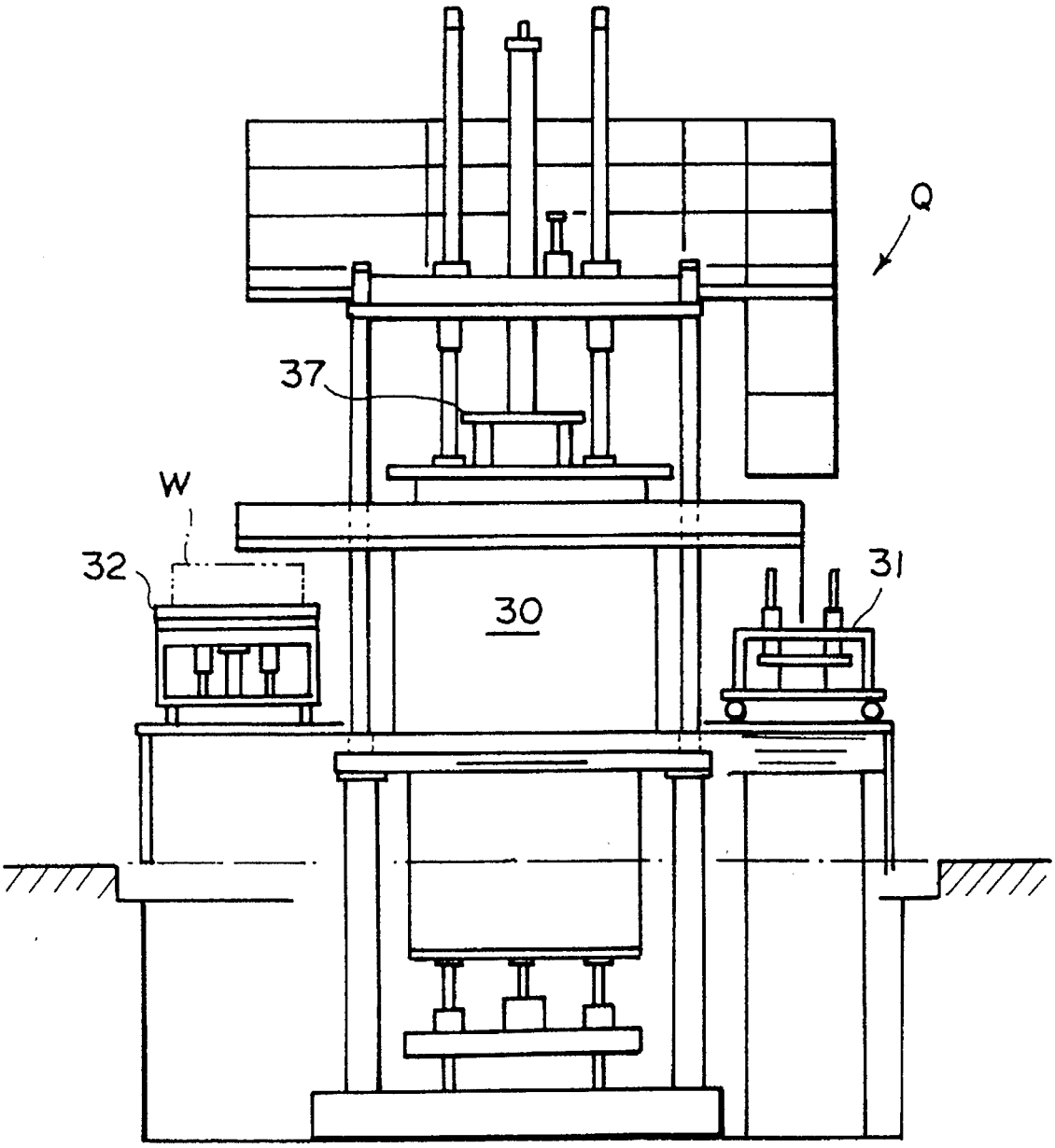
FIG. 8 is a front view of the casting apparatus.
Figure 9:
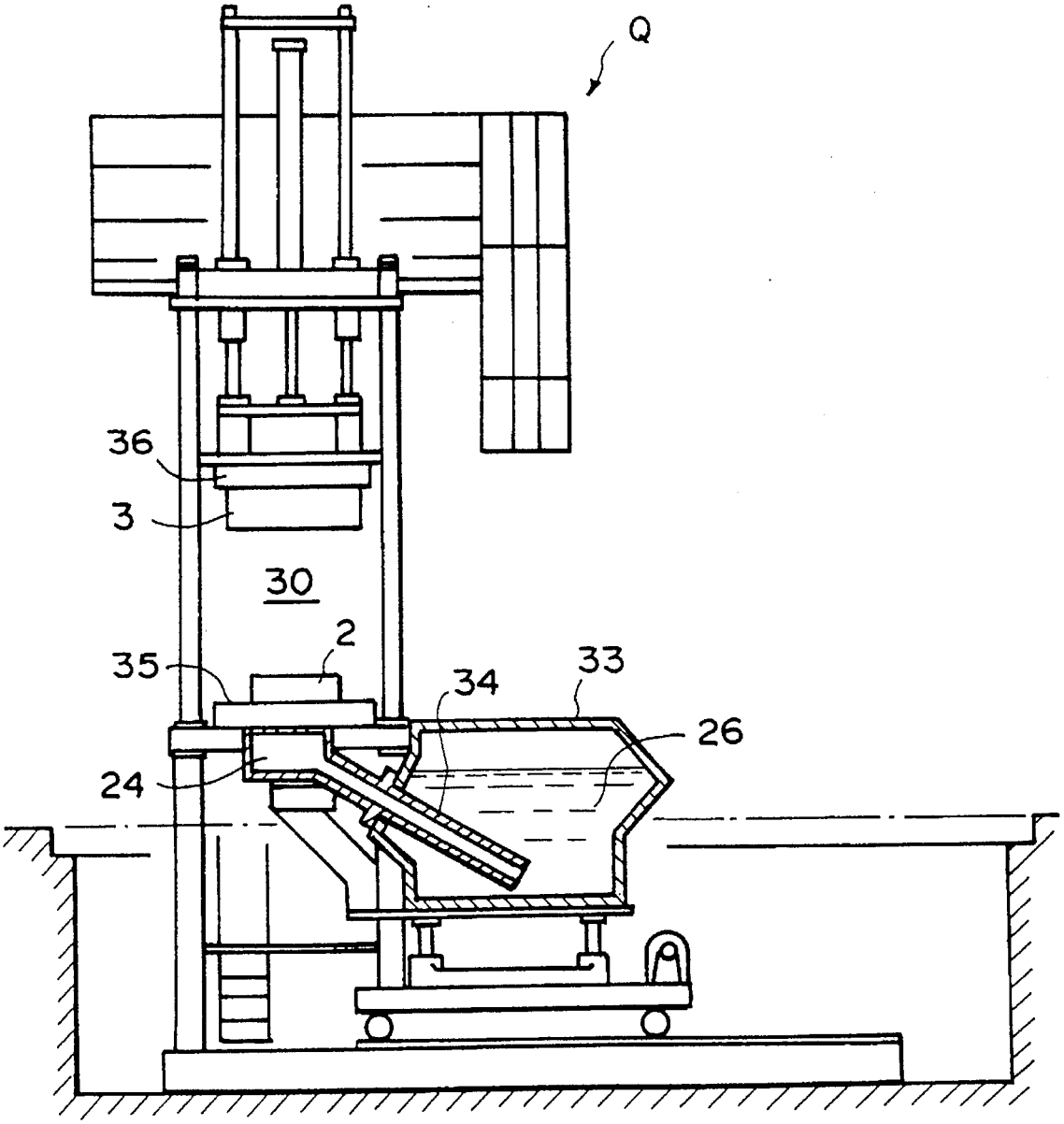
FIG. 9 is a side view of the casting apparatus.

FIGS. 8 and 9 are respectively a front view and a side view of a casting apparatus Q in which the casting mold 1 is employed.

The casting apparatus Q comprises a casting machine 30, a core setter 31 for supplying the core assemblies 4 to the casting machine 30, and an extractor 32 which takes out the cast products W (with the core assemblies 4) from the casting machine 30. The casting machine 30 is connected through a stalk 34 to a furnace 33 in which molten metal 26 is stored. The molten metal 26 in the furnace 33 is supplied to the distributor 24 through the stalk 34. The lower mold 2 is fixedly mounted on a lower platen 35 and the upper mold 3 is fixedly mounted on an upper platen 36. Reference numeral 37 denotes an ejector plate.

A casting plant provided with a plurality of such casting apparatuses Q will be described with reference to FIGS. 10 to 13, hereinbelow. The plant has upper and lower floors, and a plurality of casting apparatuses Q are positioned on the upper floor and means for transferring the core assemblies 4 and the cast products W are positioned on the lower floor.

Figure 10:
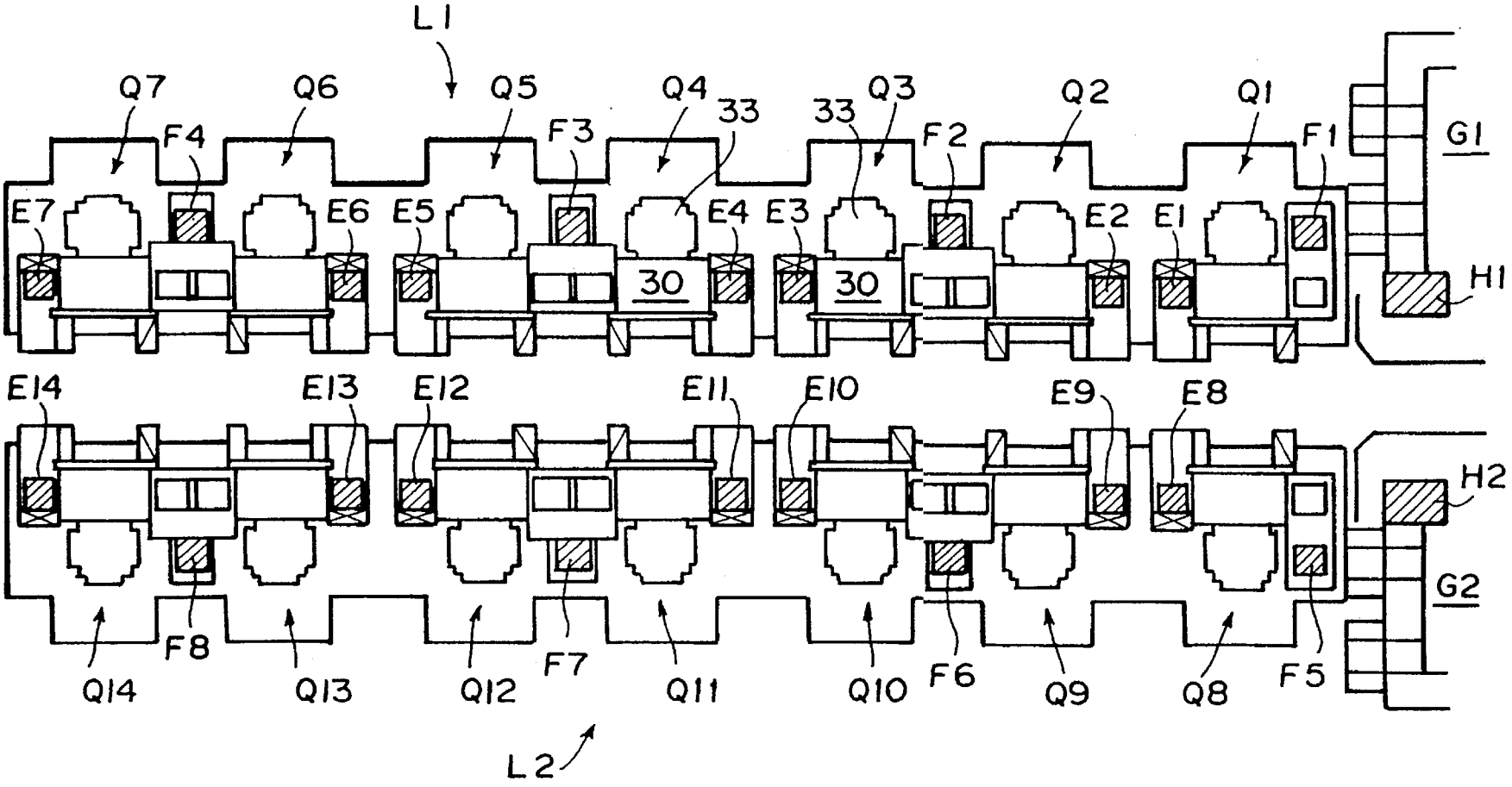
FIG. 10 is a plan view showing a part of a casting plant provided with a plurality of casting apparatuses of the present invention.

As shown in FIG. 10, fourteen casting apparatuses Q are arranged in two rows on the upper floor and form two casting lines L1 and L2. Elevators E1 to E14 are disposed beside the casting apparatuses Q and transfers pallets (not shown) with core assemblies 4 from the lower floor to the upper floor and vacant pallets from the upper floor to the lower floor. Elevators F1 to E8 are transfers pallets (not shown) with cast products W from the upper floor to the lower floor and vacant pallets from the lower floor to the upper floor. The elevators F1 to F8 are disposed between adjacent two casting apparatuses Q except the elevators F1 and F5 which are faced to core assembly lines G1 and G2 to be described later. The elevators E1 to E7 and F1 to F4 are for the casting line L1 and the elevators E8 to E14 and F5 to F8 are for the casting line L2.

Core assembly lines G1 and G2 are provided respectively at the right hand ends of the casting lines L1 and L2. Elevators H1 and H2 transfers pallets with core assemblies 4 assembled by the core assembly lines G1 and G2 from the upper floor to the lower floor and vacant pallets from the lower floor to positions above the upper floor.

Figure 11:
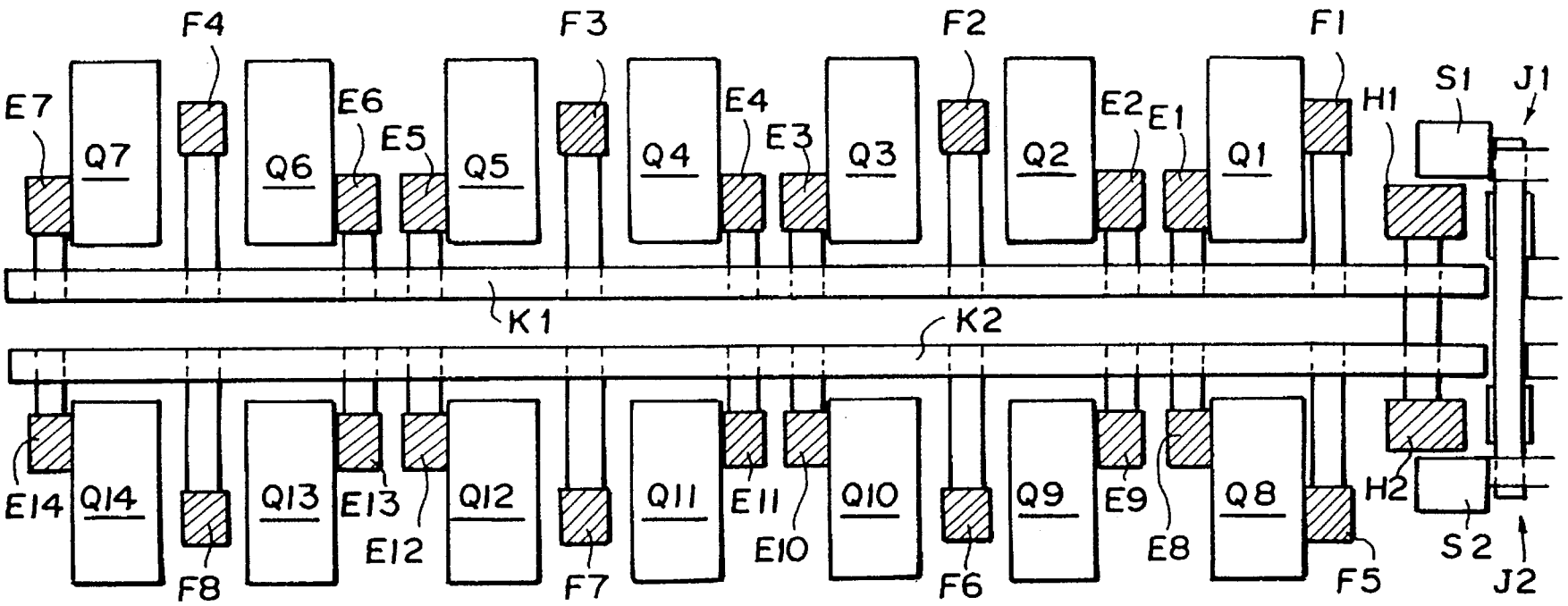
FIG. 11 is a plan view showing another part of the casting plant.

As shown in FIG. 11, a pair of parallel conveyor lines K1 and K2 are provided on the lower floor. One conveyor line K1 extends along the elevator E1 to E7 for the casting line L1 and the other conveyor line K2 extends along the elevator E8 to E14 for the casting line L2. At the right hand ends of the conveyor lines K1 and K2, there are respectively provided after-treatment lines J1 and J2 for carrying out after-treatments such as removal of core assemblies 4 from the cast products W, cutting the gates and the like. Stockers S1 to S2 for stocking vacant pallets are provided close to the elevators H1 and H2.

Figure 12:
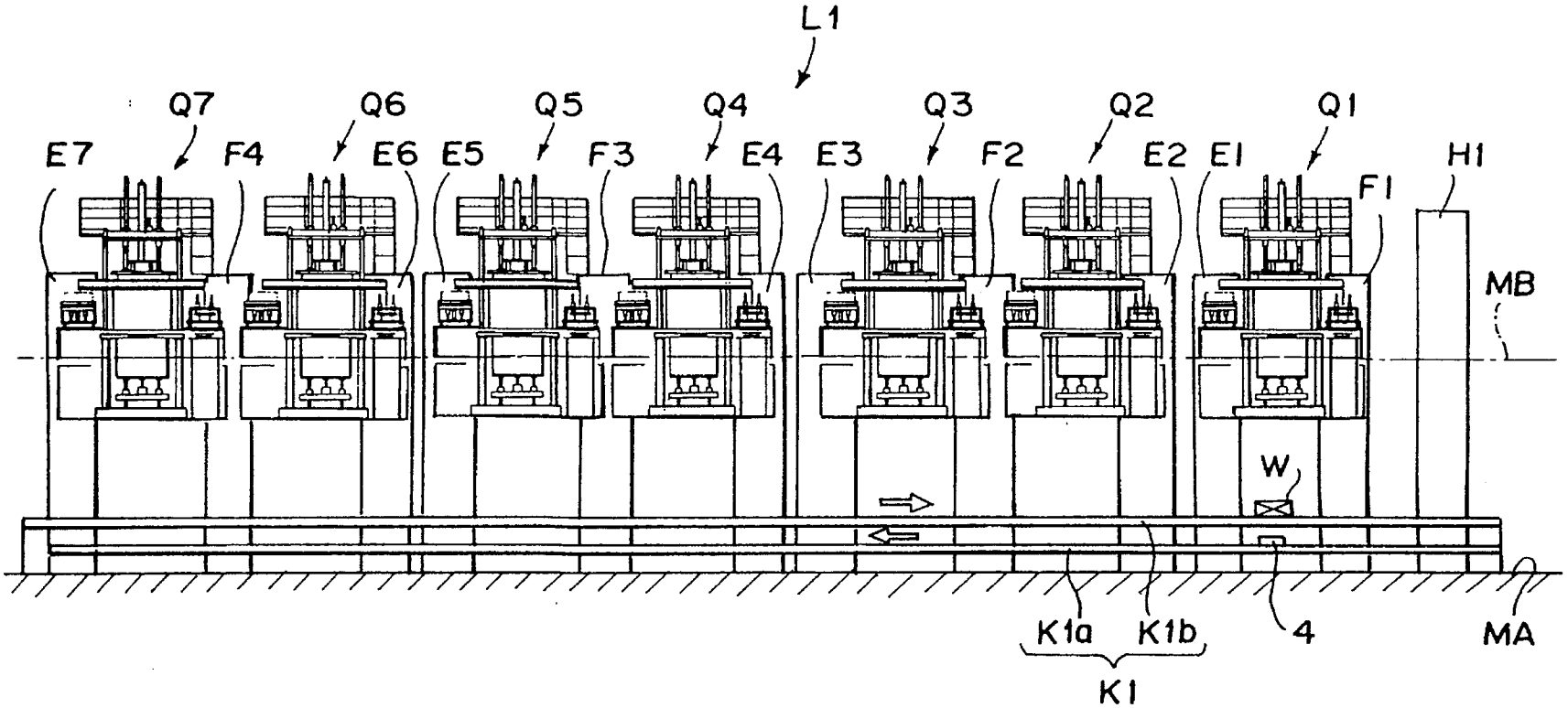
FIG. 12 is a front view of the casting plant.

FIG. 12 shows the casting line L1 and the conveyor line K1. MA denotes the surface of the lower floor and MB denotes the surface of the upper floor.

The conveyor line K1 comprises lower and upper conveyors K1*a* and K1*b*. The lower conveyor K1*a* runs leftward in FIG. 12 and conveys the pallets with the core assemblies 4 assembled in the core assembly line G1 to the elevators E1 to E7 and the vacant pallets to the elevators F1 to F4. The upper conveyor K1*b* runs rightward and conveys the pallets with the cast products W which are transferred from the upper floor to the lower floor by the elevators F1 to F4 to the after-treatment line J1 and the vacant pallets which are transferred from the upper floor to the lower floor by the elevators E1 to E7 to the elevator H1. The conveyor line K2 is of the same arrangement.

Figure 13:
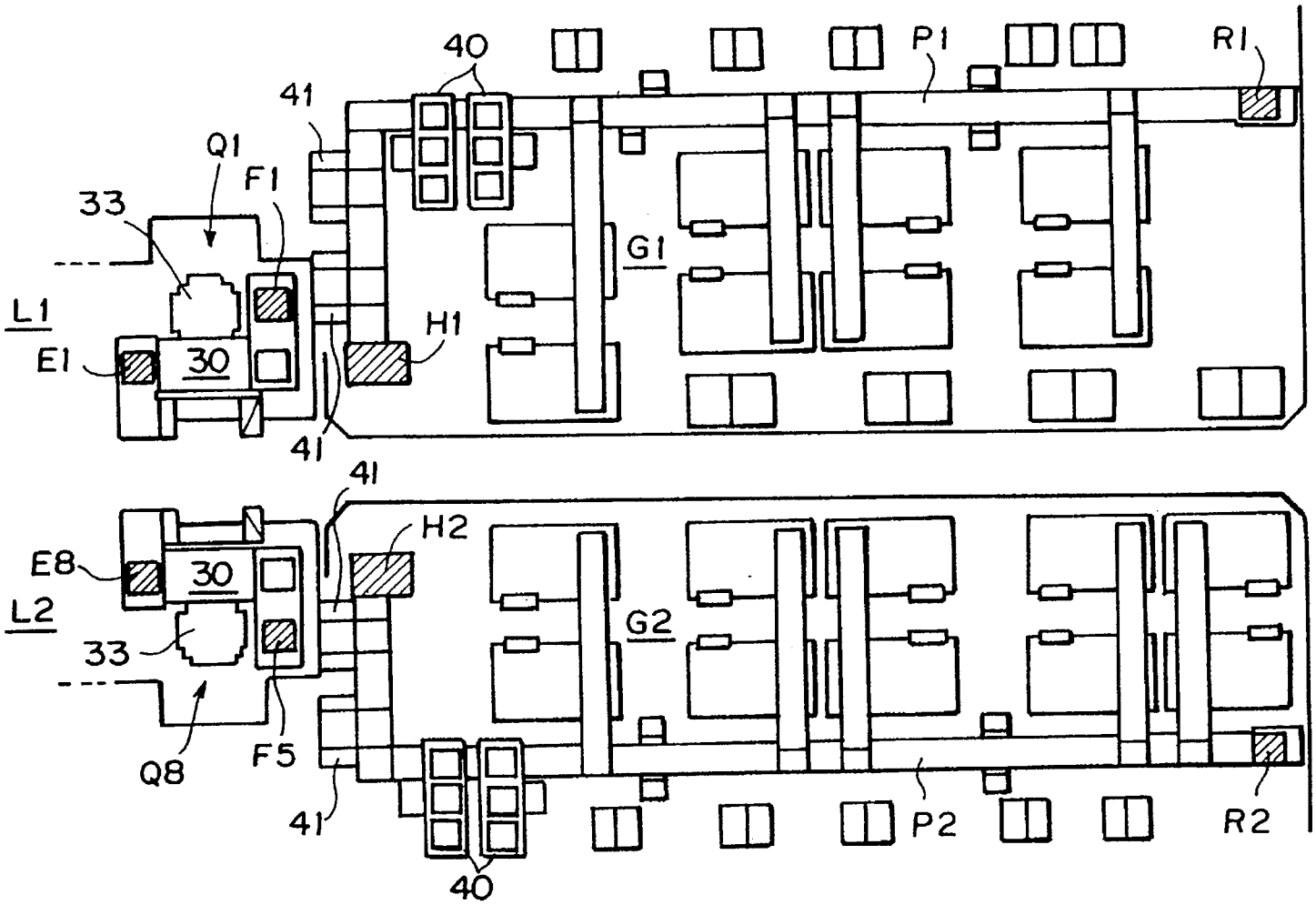
FIG. 13 is a plan view of a core assembly line of the plant.

FIG. 13 shows the layout in the core assembly lines G1 and G2 on the lower floor. P1 and P2 respectively denote core conveyor lines each having upper and lower conveyors. The upper conveyors of the respective core conveyor lines P1 and P2 runs rightward and convey vacant pallets from the upper ends of the elevators H1 and H2 to the upper ends of elevators R1 and R2 disposed at the right side ends. The elevators R1 and R2 are returning elevators for transferring the vacant pallets from the ends of the upper conveyors to the beginnings of the lower conveyors.

The return elevators R1 and R2 are of the substantially the same heights as the elevators H1 and H2. The upper ends of the elevators R1 and R2 are respectively connected with the upper ends of the elevators H1 and H2 by the upper conveyors and the lower ends of the elevators R1 and R2 are respectively connected with the lower ends of the elevators H1 and H2 by the lower conveyors. The vacant pallets conveyed above the surface MB of the upper floor by the elevator H1 and H2 are conveyed respectively to the upper ends of the elevator R1 and R2 by the upper conveyors of the conveyor lines P1 and P2, and then transferred respectively to the lower conveyors of the conveyor lines P1 and P2 by the elevators R1 and R2.

The core assemblies 4 assembled by the core assembly line G1 and G2 are placed on the pallets, and conveyed leftward by the lower conveyors, and then stocked in a core stocker 40 together with data thereon. Upon receipt of a delivery requirement signal from the casting apparatuses Q1 to Q14, the core assemblies 4 are delivered from the stocker 40 and bonded by bonding machines 41, and then conveyed to the elevators H1 and H2. Thereafter the core assemblies 4 are transferred to the lower floor by the elevators H1 and H2 and placed on the lower conveyors of the conveyor lines K1 and K2.

Assuming that the delivery requirement signal is output from the casting apparatus Q5 of the casting line L1, the core assemblies 4 are conveyed to the elevator E5 by the lower conveyor K1*a* and then transferred to the upper floor by the elevator E5. Then the core assemblies 4 are set to the casting mold 1 on the casting machine 30 by the core setter 31 of the casting apparatus Q5 and casting is carried out in the manner described above.

The pallets from which the core assemblies 4 are removed is transferred to the lower floor and is conveyed to the elevator H1 by the upper conveyor K1*b*. Then the vacant pallet is lifted above the surface MB of the upper floor and conveyed to the upper end of the elevator R1 by the upper conveyor of the conveyor line P1. Then the vacant pallet is transferred downward by the elevator R1 on to the lower conveyor of the conveyor line P1 and returned to the core assembly line G1.

The cast products W cast by the casting machine 30 of the casting apparatus Q5 are taken out from the casting mold 1 by the extractor 32 and transferred to the lower floor by the elevator F3. Then the cast products W are conveyed rightward to the after-treatment line J1 and are subjected to after-treatments such as removal of core assemblies 4 from the cast products W, cutting the gates and the like.

As can be understood from the description above, the casting plant of this example has a two-floor structure wherein the casting apparatuses Q1 to Q14 are disposed on the upper floor and the conveyor lines K1 and K2 for conveying the core assemblies 4 and the cast products W are disposed on the lower floor. Accordingly, in this plant, the space factor is excellent, and many casting apparatuses can be installed in a limited space, and the structure about the casting machines can be simplified, whereby maintenance is facilitated.

Further since each of the conveyor line K1 and K2 comprises a core assembly carrying-in line (the lower conveyor) and a cast product carrying-out line (the upper conveyor), carrying the core assemblies 4 in the casting apparatuses Q1 to Q14 and carrying the cast products W out therefrom can be effected with a very high efficiency.

An example of a control routine executed by a centralized controller when the casting plant is controlled by the centralized controller will be described with reference to the flow charts shown in FIGS. 14 to 17, hereinbelow. For the purpose of simplification, the following description is made with respect to the casting apparatus Q5 in the casting L1.

Figure 14:
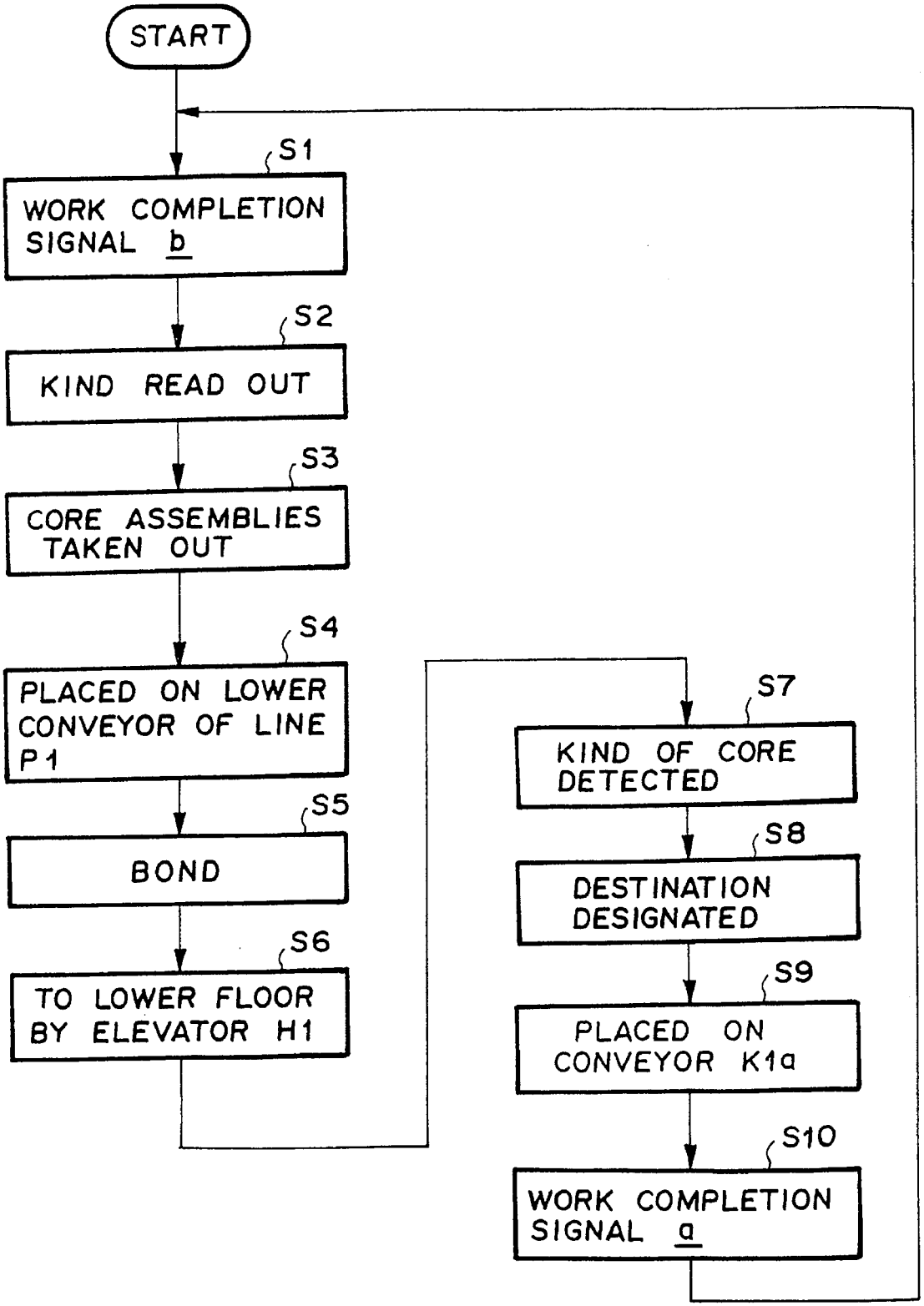
FIG. 14 is a flow chart showing the core delivery routine.

FIG. 14 is a flow chart showing the core delivery routine for delivering the core assemblies 4 (non-bonded) from the core stocker 40 in the core assembly line G1.

When receiving a work completion signal (to be described later) from the casting machine (step S1), the centralized controller reads out the kind of the core assemblies 4 to be delivered from the delivery requirement signal (step S2). Then the centralized controller causes the core assemblies 4 of the designated kind to be taken out from the core stocker 40 (step S3), and conveyed to the bonding machine 41 by the lower conveyor of the conveyor line P1 (step S4). The centralized controller causes the bonding machine 41 to inject adhesive into the core assemblies 4 to bond them. (step S5) The centralized controller causes the bonded core assemblies 4 to be transferred to the lower floor by the elevator H1 (step S6) Then the centralized controller detects the kind of the core assemblies 4 (step S7) and designates the destination (step S8). Thereafter the centralized controller causes the core assemblies 4 to be placed on the lower conveyor K1*a* of the conveyor line K1 (step S9) and generates a work completion signal a (step S10). Thus one cycle of the core delivery routine is ended.

Figure 15:
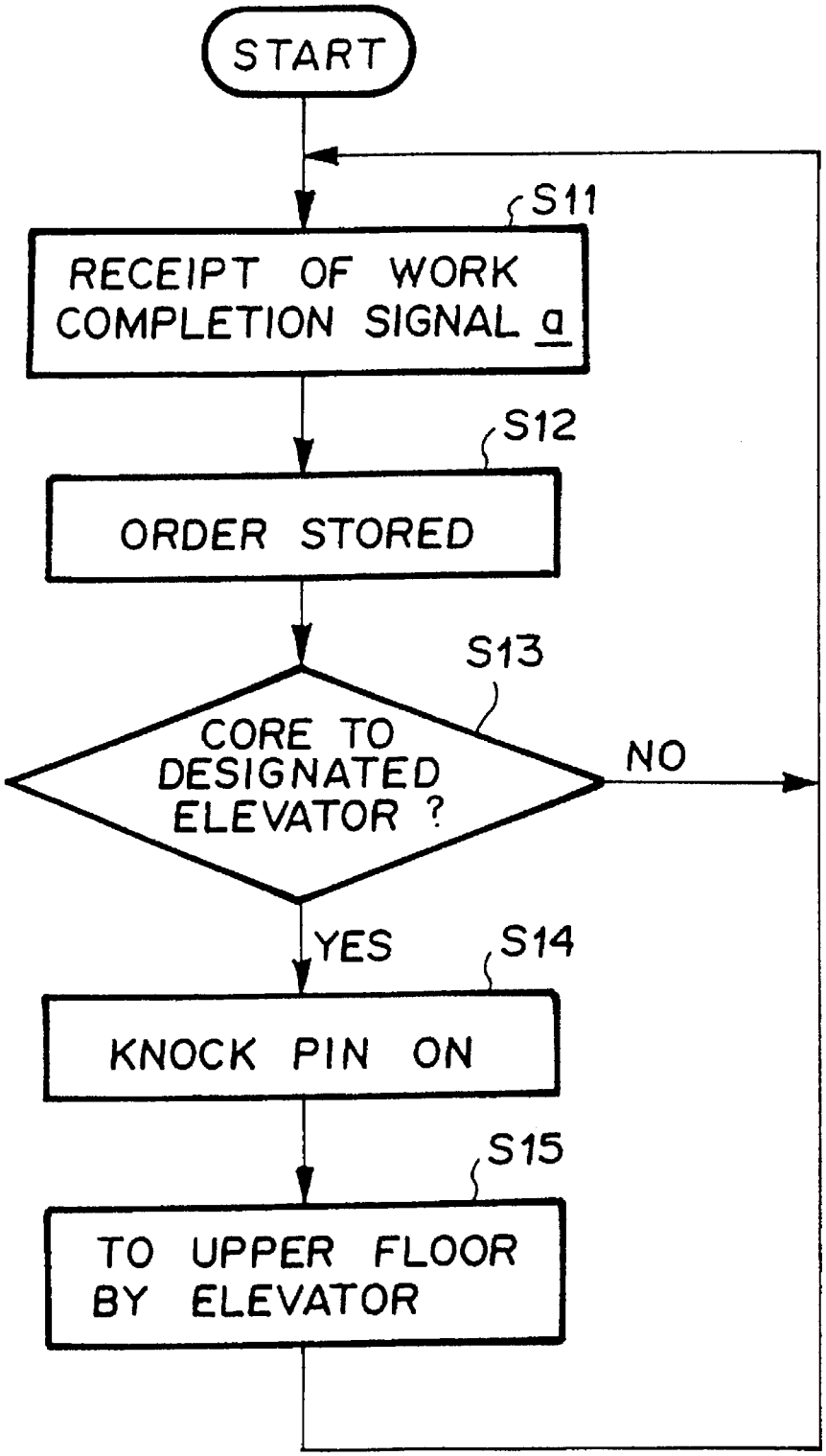
FIG. 15 is a flow chart showing the core carrying in routine.

FIG. 15 is a flow chart showing the core carrying-in routine for carrying the core assemblies 4 in the casting apparatus Q5.

When receiving the work completion signal a (step S11), the centralized controller stores in a memory the order of the core assemblies 4 to be conveyed by the lower conveyor K1*a* of the conveyor line K1 (step S12). Then the centralized controller determines whether desired core assemblies 4 reach the elevator E5 for the casting apparatus Q5 (which output the delivery requirement signal) by a limit switch provided on the lower conveyor K1*a*). (step S13) When it is determined that the desired core assemblies 4 reach the elevator E5, the centralized controller causes a knock pin (not shown) to stop the core assemblies 4 at the elevator E5 (step S14), and causes the core assemblies 4 to be transferred to the upper floor by the elevator E5 (step S15). Thus one cycle of the core carrying-in routine is ended.

Figure 16:
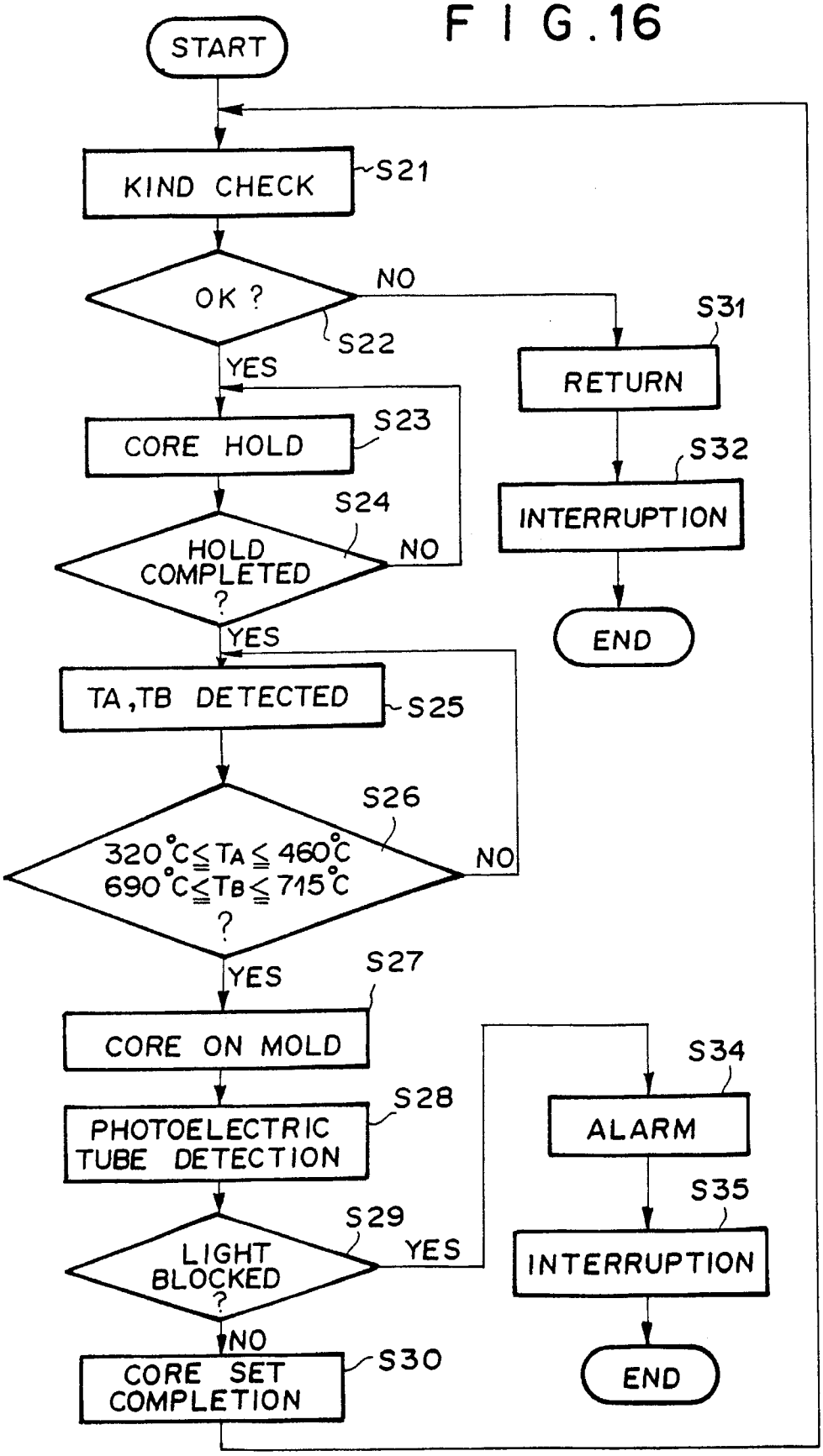
FIG. 16 is a flow chart showing the core setting routine.

FIG. 16 is a flow chart showing the core setting routine for setting the core assemblies 4 to the casting casting machine 30 of the casting apparatus Q5.

The centralized controller checks the kind of the core assemblies 4 delivered, (step S21) When the core assemblies 4 delivered do not conform to the requirement, the centralized controller returns the core assemblies 4 by the elevator E5, and generates a work completion signal. (steps S22, S31 and S32) When the core assemblies 4 delivered conform to the requirement, the centralized controller causes the core setter 31 to hold the core assemblies 4. When the core setter complete holding the core assemblies 4, the centralized controller detects the temperature $T_A$ of the casting mold 1 and the temperature $T_B$ of the molten metal. (steps S24 and S25) Then the centralized controller determines whether the temperatures $T_A$ and $T_B$ are in the ranges of 320° C. to 460° C. and 690° C. to 715° C., respectively. (step S26)

When it is determined that the temperatures $T_A$ and $T_B$ are in the ranges, the centralized controller causes the core setter 31 to place the core assemblies 4 on the casting mold 1. (step S26) Then the centralized controller detects whether the core assemblies 4 are positioned in place by use of photoelectric tubes. When it is determined that the core assemblies 4 do not block light, the centralized controller generates a core setting completion signal, and otherwise alarms and interrupts the operation. (steps S28 to S30 and S34 and S35)

Figure 17:
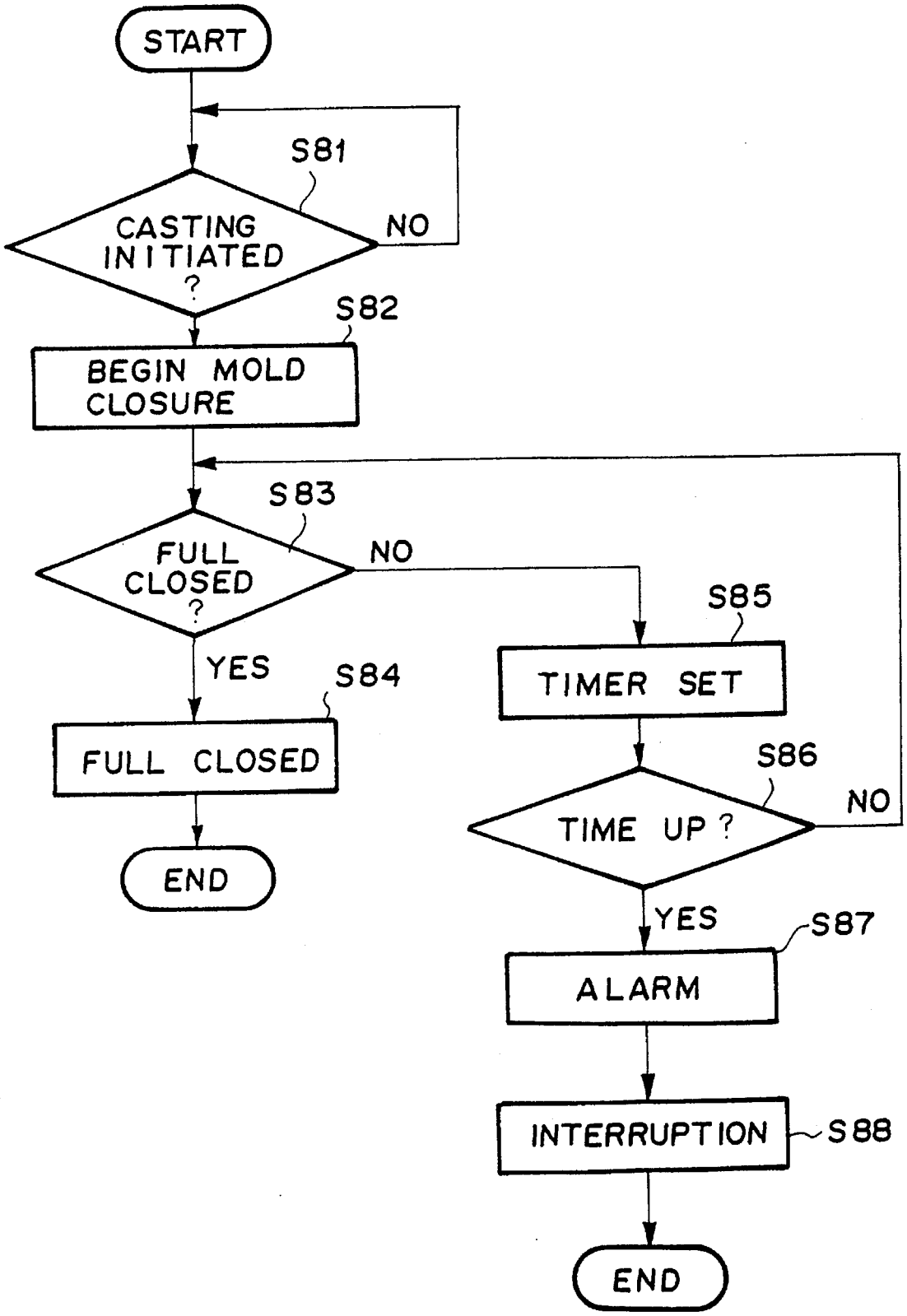
FIG. 17 is a flow chart showing the mold closing routine.

FIG. 17 is a flow chart showing a mold closing routine.

The centralized controller first determines whether casting is to be initiated. (step S81) When it is determined that casting is to be initiated, the centralized controller begins to close the casting mold 1. (step S82) Then the centralized controller determines whether the casting mold 1 has been completely closed. (step S83) When it is determined that the casting mold 1 has been completely closed, the centralized controller sets a mold closure completion flag. (step S84) Otherwise, the centralized controller sets a timer, and when the casting mold 1 is not completely closed before lapse of the time set to the timer, the centralized controller alarms and interrupts the operation. (steps S85 to S88)

What is claimed is:

1. A low-pressure casting apparatus provided with a casting mold which can be opened and closed and is closed to form therein a cavity having a top wall, a bottom wall and a side wall, which is filled with molten metal to form a cast product, comprising an upper mold of metal, a lower mold of metal and a sand mold which is disposed between the upper and lower molds and a limiting member formed integrally with said upper mold for limiting the space between the upper and lower molds and surrounding said sand mold when the cast product is being formed wherein said upper molds forms a top wall of the cavity, said lower mold forms a lower wall of the cavity and said sand mold forms all walls of said cavity except said upper and lower walls formed by said upper and lower molds.

2. A low-pressure casting apparatus provided with a casting mold which can be opened and closed and is closed to form therein a cavity which is filled with molten metal to form a cast product, characterized in that said casting mold comprises an upper mold of metal, a lower mold of metal and it sand mold which is disposed between the upper and lower molds, the sand mold comprising a base frame, a core member disposed on the base frame, and an outer frame which is disposed on the base frame to support the core member together with the base frame;

wherein only said base frame, said core member and said outer frame form side walls of the cavity.

3. A low-pressure casting apparatus provided with a casting mold which can be opened and closed and is closed to form therein a cavity which is filled with molten metal to form a cast product, said casting mold comprising a single upper mold of metal, a single lower mold of metal and a pair of sand molds which are disposed between the upper and lower molds forming first and second cavities, each of said first and second cavities including a top wall formed by said upper mold, a bottom wall formed by said lower mold and side walls positioned between said upper and lower mold formed by said sand molds; a gate formed in a position between the sand molds and a distributing passage for distributing molten metal to each of said first and second cavities formed by the sand molds through the gate;

wherein said sand molds form all walls of each of said cavities except said upper and lower walls formed by said upper and lower molds.

4. A low-pressure casting method for casting a product comprising the steps of preparing a casting mold comprising an upper metal mold, a lower metal mold and a sand mold which is disposed between the upper and lower metal molds thereby forming a cavity, forming at least a portion of a top wall of the cavity by said upper metal mold, at least a portion of a bottom wall of the cavity by said lower metal mold and all remaining walls of the cavity by said sand mold, filling the cavity with molten metal, and opening the casting mold after the molten metal is solidified.

5. A low-pressure casting method as defined in claim 4 wherein said sand mold is arranged such that when the casting mold is opened the cast product and the sand mold are held on the upper mold with the cast product and the sand mold being subsequently removed from the upper mold.

6. A low-pressure casting method as defined in claim 5, wherein the step of removing the cast product includes removing the cast product from the upper metal mold by an extractor.

7. A low-pressure casting method as defined in claim 6, wherein the upper metal mold and lower metal mold are fixedly secured to a casting means for forming the casting mold, the method further comprising the step of placing said sand mold on an upper surface of said lower metal mold by way of a setter.

8. A low-pressure casting method as defined in claim 7, further comprising the step of assembling said sand mold from a plurality of cores prior to placing said sand mold on said upper surface of said lower metal mold.

9. A low-pressure casting method as defined in claim 8, wherein said plurality of cores are bonded together after said plurality of cores are assembled to form said sand mold.

10. A low-pressure casting method as defined in claim 9, wherein said cores after assembly stocked adjacent said casting means and selectively removed and bonded to form said sand mold.

11. A low-pressure casting method as defined in claim 4, wherein said casting mold is prepared by positioning said sand mold on an upper surface of said lower mold and positioning said upper mold on an upper surface of said sand mold.

12. A low-pressure casting method as defined in claim 11, wherein said sand mold forms all side walls of said casting mold.

13. A method of forming a low-pressure casting mold comprising the steps of preparing a sand core assembly having an opening on an upper side thereof by positioning a core member on a base frame and positioning an outer frame on the core member, subsequently placing the core assembly on a lower mold, and positioning an upper mold on the core assembly to close the opening of the core assembly and thereby forming a cavity therein wherein all side walls of the cavity are formed by said outer frame of the core assembly.

14. A method of forming a low-pressure casting mold as defined in claim 13, wherein the upper mold and the lower mold are fixedly secured to a caster for forming a cast product.

15. A method of forming a low-pressure casting as defined in claim 13, further comprising the step of bonding core member, said base frame and said outer frame together to form a sand mold.

16. A method of forming a low-pressure casting as defined in claim 15, said method further comprising stocking said core assemblies in a stocker and selectively removing at least one core assembly from said stocker before said bonding step.

17. A low-pressure casting apparatus provided with a casting mold which can be opened and closed and is closed to form therein a cavity having a top wall, a bottom wall and side walls which is filled with molten metal to form a cast product, comprising an upper mold of metal forming the top wall of the cavity, a lower mold of metal forming at least a portion of the bottom wall of the cavity and a sand mold disposed between the upper and lower molds forming all remaining walls of the cavity including all side walls of the cavity.

18. A low-pressure casting apparatus as defined in claim 17 in which the top wall of the cavity is formed by a lower surface of the upper mold, and a contact surface of the upper mold for forming a cast product is of a larger surface area than a contact surface of the lower mold for forming the cast product.

19. A low-pressure casting apparatus as defined in claim 18 in which said upper mold is provided with a holding means for holding the cast product on the lower surface of the upper mold when the casting mold is opened.

20. A low pressure casting apparatus as defined in claim 19 in which said holding means comprises a projecting member which projects into the cavity from the lower surface of the upper mold.

21. A low-pressure casting apparatus as defined in claim 20 in which said projecting member is a core pin which projects into the cavity at the center thereof.

22. A low-pressure casting apparatus as defined in claim 17 in which a bulge portion is formed on an upper surface of the lower mold and a gate is formed between a side wall of the bulge portion and a side wall of the sand mold.

23. A low-pressure casting apparatus as defined in claim 22 in which a metal member which forms a part of the cavity is mounted on the bulge portion of the lower mold.

* * * * *